US006592217B2

(12) United States Patent
Tanaami

(10) Patent No.: US 6,592,217 B2
(45) Date of Patent: Jul. 15, 2003

(54) RECORDING APPARATUS

(75) Inventor: Hideyuki Tanaami, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/096,751

(22) Filed: Mar. 14, 2002

(65) Prior Publication Data

US 2002/0130941 A1 Sep. 19, 2002

(30) Foreign Application Priority Data

Mar. 16, 2001 (JP) ..... 2001/076081

(51) Int. Cl.[7] ..... B65H 19/22
(52) U.S. Cl. ..... 347/104; 242/560; 226/143
(58) Field of Search ..... 242/560, 564.4, 242/563.2; 226/110, 143; 346/136; 400/613, 613.1, 605, 609, 607, 607.1, 608.3, 613.2, 613.3, 613.4, 614, 614.1, 615, 615.1, 615.2; 347/104, 4

(56) References Cited

U.S. PATENT DOCUMENTS 4,003,527 A * 1/1977 Schulze ..... 226/110
5,511,743 A * 4/1996 Kozlowsky et al. ..... 242/560

FOREIGN PATENT DOCUMENTS

JP 356070254 A * 6/1981 ..... 242/563.2
JP 402144362 A * 6/1990 ..... 242/563.2
JP 404354749 A * 12/1992 ..... 242/564.4

* cited by examiner

*Primary Examiner*—Thinh Nguyen
*Assistant Examiner*—Julian D. Huffman
(74) *Attorney, Agent, or Firm*—Fitzpatrick, Cella, Harper & Scinto

(57) ABSTRACT

During upper-stage recording (recording to rolled paper of an upper-stage roll folder) of upper/lower-stage continuous recording, if absence of the rolled paper on a spool is detected, the recording is suspended, and the rolled paper is then cut by a cutter at the suspended position, and the remaining rolled paper is taken up into the upper-stage roll folder. On one hand, during lower-stage recording (recording to rolled paper of a lower-stage roll folder), if absence of the rolled paper on a spool is detected, the recording is continued until absence of the rolled paper is detected by an in-path sensor, the recording is continued according to a remaining amount of the rolled paper after absence of the rolled paper was detected by the in-path sensor, and the remaining rolled paper is then discharged outside after the recording ended.

9 Claims, 14 Drawing Sheets

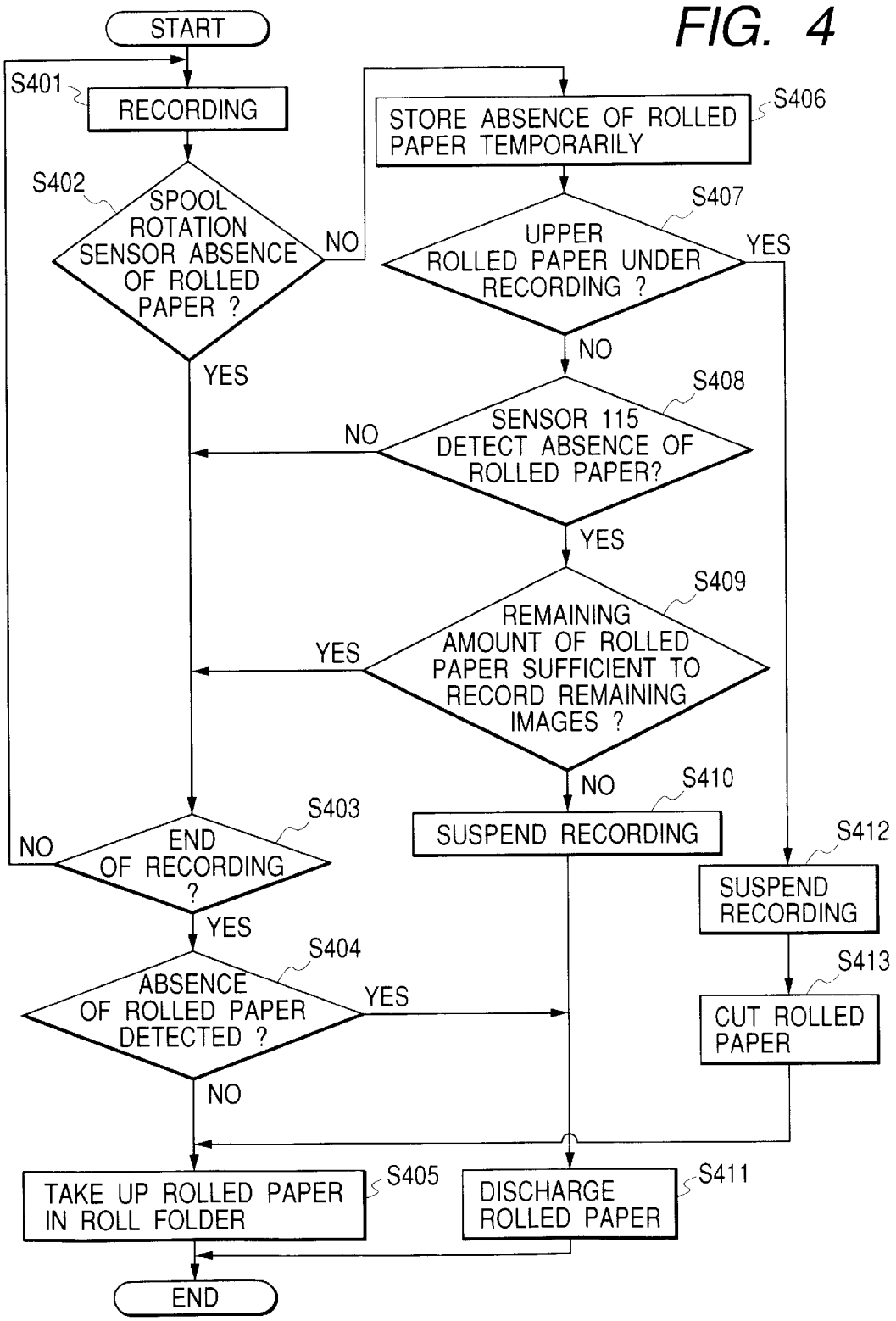
FIG. 4
START
S401
RECORDING
S402
SPOOL ROTATION SENSOR ABSENCE OF ROLLED PAPER ?
NO
YES
S406
STORE ABSENCE OF ROLLED PAPER TEMPORARILY
S407
UPPER ROLLED PAPER UNDER RECORDING ?
YES
NO
S408
SENSOR 115 DETECT ABSENCE OF ROLLED PAPER?
NO
YES
S409
REMAINING AMOUNT OF ROLLED PAPER SUFFICIENT TO RECORD REMAINING IMAGES ?
YES
NO
S410
SUSPEND RECORDING
S403
END OF RECORDING ?
NO
YES
S404
ABSENCE OF ROLLED PAPER DETECTED ?
YES
NO
S412
SUSPEND RECORDING
S413
CUT ROLLED PAPER
S405
TAKE UP ROLLED PAPER IN ROLL FOLDER
S411
DISCHARGE ROLLED PAPER
END

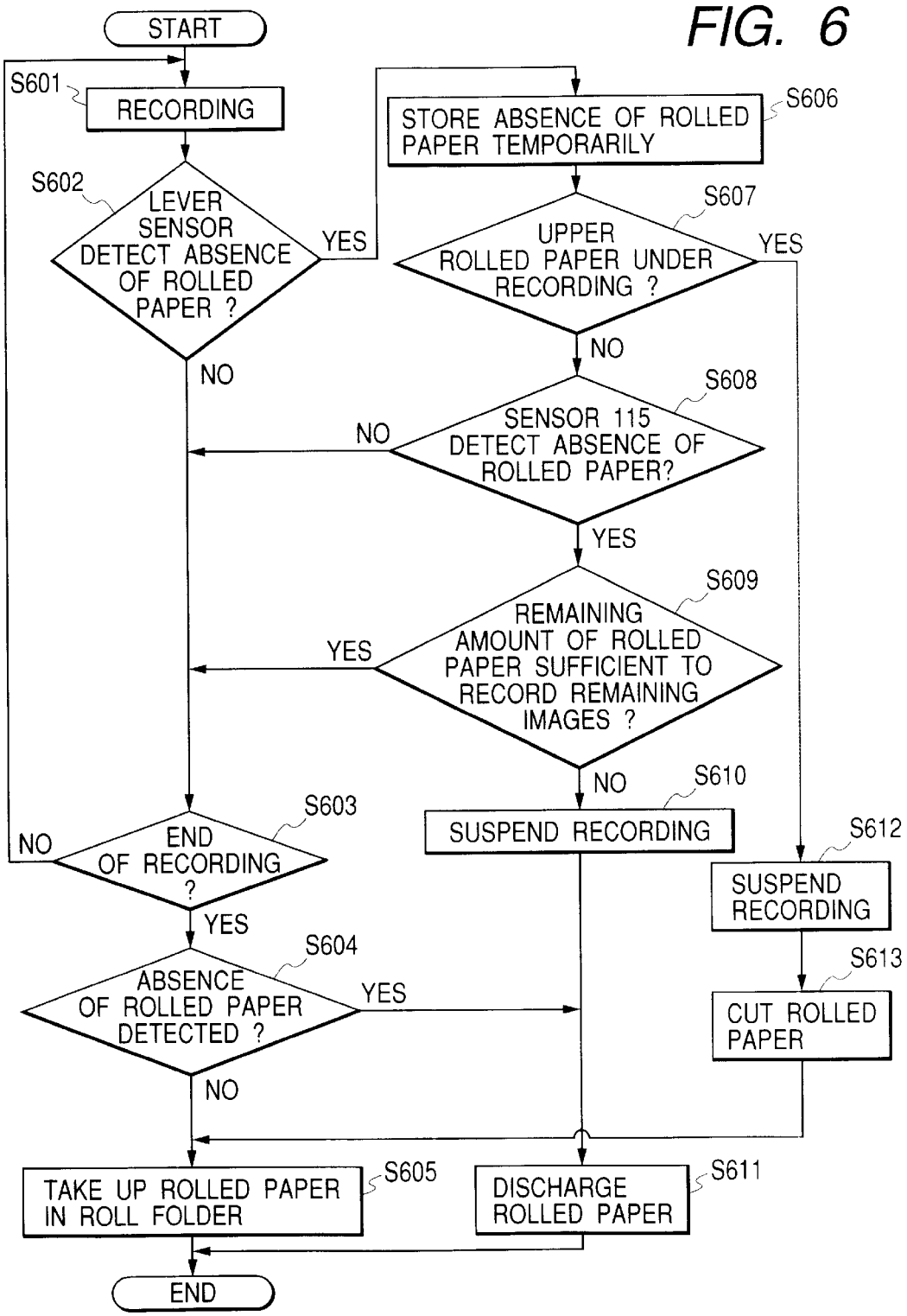
FIG. 6
START
S601
RECORDING
S602
LEVER SENSOR DETECT ABSENCE OF ROLLED PAPER ?
YES
NO
S606
STORE ABSENCE OF ROLLED PAPER TEMPORARILY
S607
UPPER ROLLED PAPER UNDER RECORDING ?
YES
NO
S608
SENSOR 115 DETECT ABSENCE OF ROLLED PAPER?
NO
YES
S609
REMAINING AMOUNT OF ROLLED PAPER SUFFICIENT TO RECORD REMAINING IMAGES ?
YES
NO
S610
SUSPEND RECORDING
S603
END OF RECORDING ?
NO
YES
S604
ABSENCE OF ROLLED PAPER DETECTED ?
YES
NO
S612
SUSPEND RECORDING
S613
CUT ROLLED PAPER
S605
TAKE UP ROLLED PAPER IN ROLL FOLDER
S611
DISCHARGE ROLLED PAPER
END

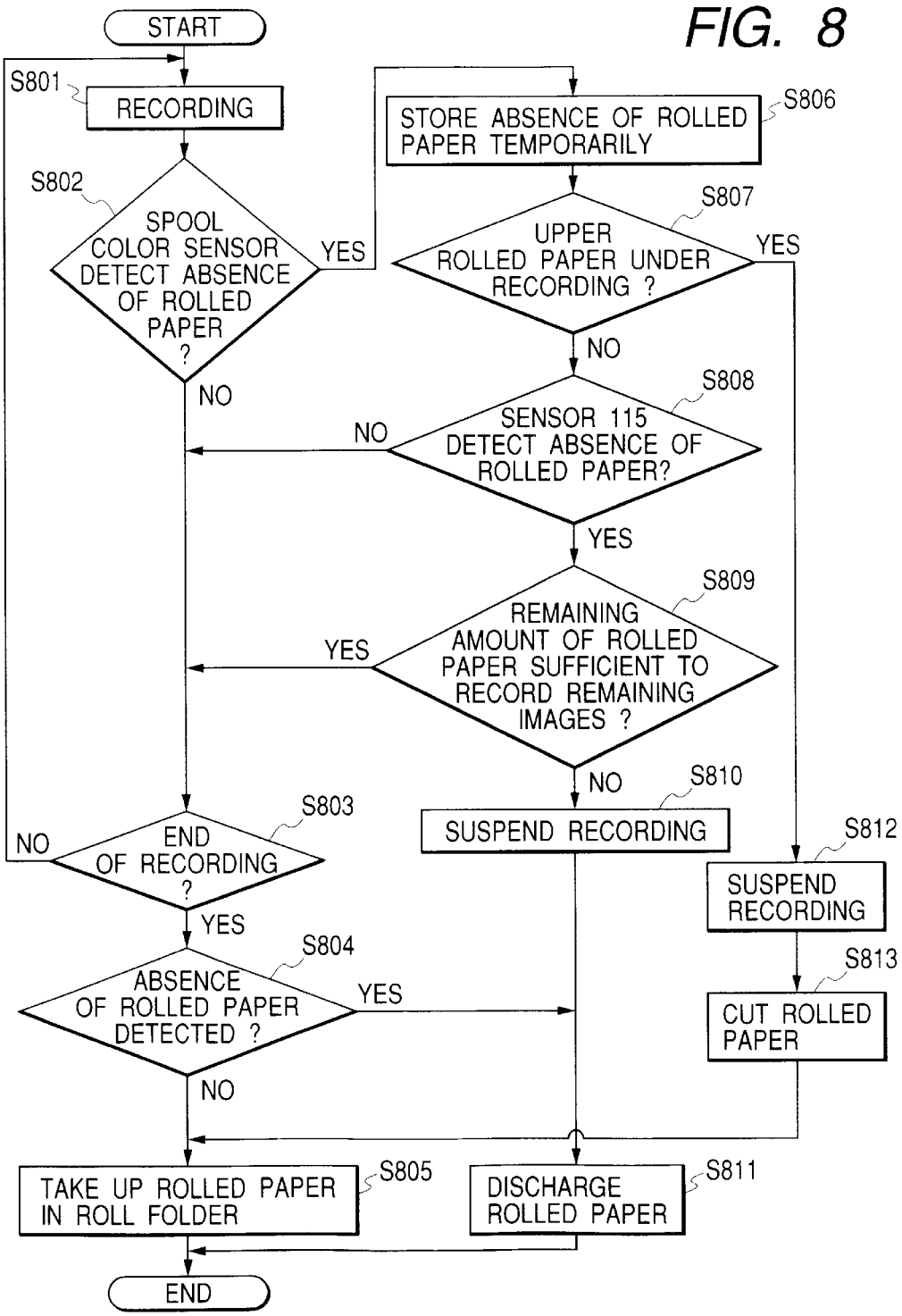
FIG. 8
START
S801
RECORDING
S802
SPOOL COLOR SENSOR DETECT ABSENCE OF ROLLED PAPER ?
YES
NO
S806
STORE ABSENCE OF ROLLED PAPER TEMPORARILY
S807
UPPER ROLLED PAPER UNDER RECORDING ?
YES
NO
S808
SENSOR 115 DETECT ABSENCE OF ROLLED PAPER?
NO
YES
S809
REMAINING AMOUNT OF ROLLED PAPER SUFFICIENT TO RECORD REMAINING IMAGES ?
YES
NO
S810
SUSPEND RECORDING
S803
END OF RECORDING ?
NO
YES
S804
ABSENCE OF ROLLED PAPER DETECTED ?
YES
NO
S812
SUSPEND RECORDING
S813
CUT ROLLED PAPER
S805
TAKE UP ROLLED PAPER IN ROLL FOLDER
S811
DISCHARGE ROLLED PAPER
END

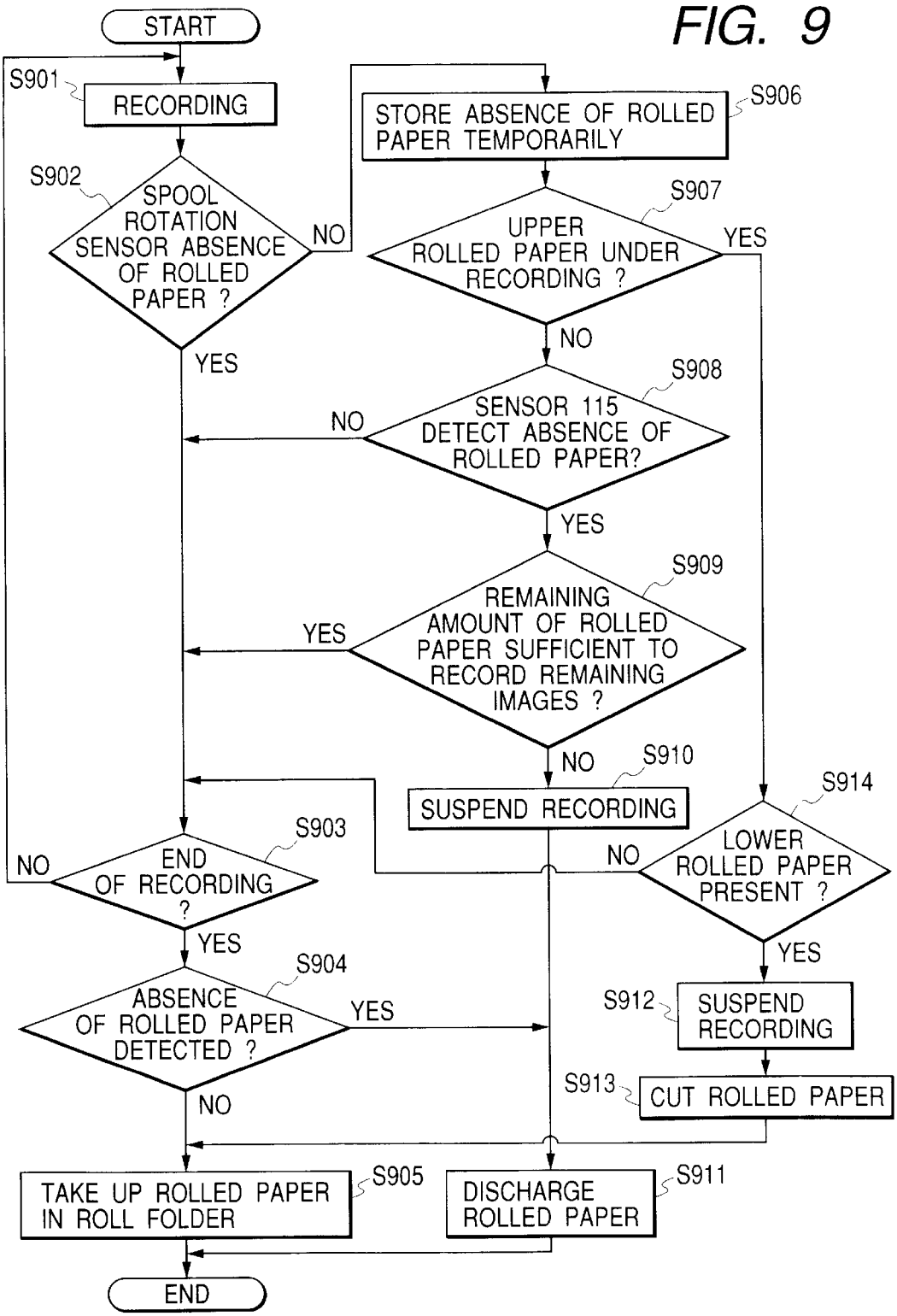
FIG. 9
START
S901
RECORDING
S902
SPOOL ROTATION SENSOR ABSENCE OF ROLLED PAPER ?
NO
YES
S906
STORE ABSENCE OF ROLLED PAPER TEMPORARILY
S907
UPPER ROLLED PAPER UNDER RECORDING ?
YES
NO
S908
SENSOR 115 DETECT ABSENCE OF ROLLED PAPER?
NO
YES
S909
REMAINING AMOUNT OF ROLLED PAPER SUFFICIENT TO RECORD REMAINING IMAGES ?
YES
NO
S910
SUSPEND RECORDING
S914
LOWER ROLLED PAPER PRESENT ?
NO
YES
S903
END OF RECORDING ?
NO
YES
S904
ABSENCE OF ROLLED PAPER DETECTED ?
YES
NO
S912
SUSPEND RECORDING
S913
CUT ROLLED PAPER
S905
TAKE UP ROLLED PAPER IN ROLL FOLDER
S911
DISCHARGE ROLLED PAPER
END

RECORDING APPARATUS

BACKGROUND OF THE INVENTION

1. Field of the Invention

The present invention relates to a recording apparatus such as a printer, a facsimile machine, a copying machine or the like, and more particularly, to a recording apparatus which records images, characters and the like to a rolled recording material such as a rolled recording paper, a rolled recording film or the like.

2. Related Background Art

Conventionally, as a recording apparatus which performs recording to a rolled recording material, generally, the apparatus of the structure described as follows is known.

FIG. 10 is a sectional view showing a structural example (of a paper path) of the conventional recording apparatus. The recording apparatus shown in FIG. 10 adopts an ink-jet system in which a recording head performs recording as scanning on the rolled recording material, and intermittently conveys the rolled recording material while the recording is being performed. In the recording apparatus, a rolled recording paper (called a rolled paper hereinafter) is used as the rolled recording material.

The recording apparatus shown in FIG. 10 roughly consists of a roll folder 100 which rotatably holds and feeds a rolled paper Pr, a recording unit 130 which records images, characters and the like onto the rolled paper Pr in a state that the rolled paper Pr is held on a platen 134, a rolled paper conveying unit 110 which conveys the rolled paper Pr from the roll folder 100 to the recording unit 130, a discharge unit 140 which cuts the rolled paper Pr to which the recording was performed by the recording unit 130 and discharges the cut paper outside the recording apparatus, and an in-path rolled paper sensor 115 which detects presence and absence of the rolled paper Pr in the conveying path of the rolled paper conveying unit 110.

The roll folder 100 includes a rotatably supported spool 101, and the rolled paper Pr is rolled around a paper tube. When the rolled paper Pr is put inside the roll folder 100, the spool 101 is passed internally in the paper tube, and the spool 101 and the paper tube are then fixed. Hereinafter, the paper tube and the spool are together called the spool. Moreover, the leading edge (A in FIG. 10) of the rolled paper Pr is set as being nipped by a feed roller 102. If the rolled paper Pr is drawn out by the feed roller 102 in such a state, the rolled paper Pr and the spool 101 in the roll folder 100 are integrally rotated.

The roll folder 100 is made drawable to this side of the apparatus (the right in FIG. 10), so that the rolled paper Pr can be easily exchanged.

Hereinafter, an operation of the recording apparatus structured as above will be explained.

First, a paper feed operation is started, and the rolled paper Pr is conveyed from the roll folder 100 by the rotation of the feed roller 102.

If the rolled paper Pr reaches the rolled paper conveying unit 110, this paper is then conveyed to the recording unit 130 by conveying force of a conveying roller 111 and guiding of pairs of conveying guides 113 and 114, and further conveyed onto the platen 134 as being rolled on the surface of a conveying roller 131.

If the leading edge of the rolled paper Pr passes a discharge sensor 144 in the discharge unit 140, the rolled paper Pr is stopped after elapsing predetermined time period.

Subsequently, a recording operation is started, and the images, the characters and the like are recorded, by a recording head 135, to the rolled paper Pr put on the platen 134.

If the recording operation ends, the rolled paper Pr is conveyed by a pre-cutter discharge roller 141 and a post-cutter discharge roller 143 until the recorded portion of the rolled paper Pr reaches the position at the downstream of a cutter 142.

After then, a cut operation is performed by the cutter 142, and the recorded portion of the rolled paper Pr is discharged outside the recording apparatus. On the other hand, the rolled paper Pr which remains in the apparatus is taken up until the leading edge of the remaining rolled paper Pr reaches the position nipped by the feed roller 102, and the printing operation ends.

Here, in the recording apparatus of FIG. 10, since the pre-cutter discharge roller 141 and the post-cutter discharge roller 143 used in the discharge unit 140 are disposed immediately after the recording unit 130, each of these rollers is formed by a spur roller or the like of which the press-contact force is small so that an impression or the like due to the press-contact force of the roller does not deteriorate image quality. For this reason, the conveying force of the pre-cutter discharge roller 141 and the post-cutter discharge roller 143 for the rolled paper Pr is weak.

Particularly, since the rolled paper Pr is in the state rolled around the paper tube, this paper is curled. Thus, there is a problem that, under discharging, the rolled paper Pr is caught in the conveying path because of the curl and thus stagnates or stands easily.

Therefore, after the paper cut, such the stagnation of the rolled paper Pr is prevented by pushing the cut paper with the paper remaining inside the apparatus.

Such a cut and discharge operation of the rolled paper Pr will be explained with reference to a flow chart of FIG. 11.

FIG. 11 is the flow chart for explaining the cut and discharge operation of the rolled paper to be performed after the recording operation in the recording apparatus of FIG. 10.

If the recording operation ends, the rolled paper Pr is first conveyed by the pre-cutter discharge roller 141 and the post-cutter discharge roller 143 until the recorded portion of the rolled paper Pr reaches the position at the downstream of the cutter 142 (step S1101).

Next, the rolled paper Pr is cut by the cutter 142 (step S1102), and the recorded portion of the cut rolled paper Pr is discharged outside the recording apparatus by the post-cutter discharge roller 143, and at the same time, the remaining rolled paper Pr is conveyed toward the discharge side by the conveying roller 131 and the pre-cutter discharge roller 141 (step S1103). Thus, if the rolled paper Pr remaining inside the apparatus is conveyed toward the discharge side, the rolled paper Pr cut by the cutter 142 is pushed outside the recording apparatus, whereby discharge capability of the rolled paper Pr is improved.

After then, the rolled paper Pr remaining inside the apparatus is taken up into the roll folder 100 (step S1104), and the cut and discharge operation of the rolled paper Pr ends.

Next, the structure of a spool rotation sensor mechanism within the roll folder 100 will be explained with reference to FIG. 12. It should be noted that the spool rotation sensor mechanism is the mechanism to detect the presence and the absence of the rolled paper Pr according to the rotation of the spool 101.

FIG. 12 is a view showing an example of the spool rotation sensor mechanism within the roll folder 100 shown in FIG. 10.

In FIG. 12, a disklike slit plate 104 is fixed to a core rod 103 of the spool 101, and plural slits are formed on the slit plate 104 at equiangular intervals. Further, a transmission optical sensor 105 is fixed within the roll folder 100, and an electrical pulse is generated at timing according to the rotational speed of the spool 101 by the transmission optical sensor 105, whereby the rotation of the spool 101 is detected according to whether or not the electrical pulse is generated. The spool 101 is not driven by the motive force of a motor or the like but is rotated according to the feed roller 102 when the rolled paper Pr is conveyed, while the spool 101 is driven by the motive force of a not-shown motor or the like when the rolled paper Pr is taken up.

Therefore, if the rolled paper Pr is used up on the spool 101 during the recording operation, any electrical pulse is not generated by the transmission optical sensor 105, and thus the rotation of the spool 101 is not detected, whereby it is possible to detect that there is no rolled paper Pr in the roll folder 100.

Hereinafter, a rolled paper conveying control operation to be performed based on the detected result of the in-path rolled paper sensor 115 and a rolled paper conveying control operation to be performed based on the detected result of the spool rotation sensor mechanism within the roll folder 100 will be explained.

First, the rolled paper conveying control operation to be performed based on the detected result of the in-path rolled paper sensor 115 will be explained with reference to a flow chart shown in FIG. 13.

FIG. 13 is the flow chart for explaining an example of the rolled paper conveying control operation in the recording apparatus shown in FIG. 10, that is, shows the rolled paper conveying control operation to be performed based on the detected result concerning the presence and the absence of the rolled paper by the in-path rolled paper sensor 115.

If the recording operation is started (step S1301), it is judged whether or not the absence of the rolled paper Pr is detected by the in-path rolled paper sensor 115 (step S1302). If the absence of the rolled paper Pr is not detected, when all the recording operations end (step S1303), the process ends.

On the other hand, if the absence of the rolled paper Pr is detected by the in-path rolled paper sensor 115 in the step S1302, the recording operation is suspended (step S1304), and the discharge operation of the rolled paper Pr to the outside of the recording apparatus is started (step S1305).

In the discharge operation of the rolled paper Pr, if the trailing edge of the rolled paper Pr is detected by the discharge sensor 144 (step S1306), it is considered that the rolled paper Pr is discharged outside the recording apparatus without terror after elapse of a predetermined time period, and the conveying of the rolled paper Pr is stopped (step S1307).

On the other hand, if the trailing edge of the rolled paper Pr is not detected by the discharge sensor 144 in the step S1306, it is considered, after elapse of a predetermined time period (step S1308), that a jam in discharging occurred (step S1309).

Next, the rolled paper conveying control operation to be performed based on the detected result of the spool rotation sensor mechanism within the roll folder 100 will be explained with reference to a flow chart shown in FIG. 14.

FIG. 14 is the flow chart for explaining another example of the rolled paper conveying control operation in the recording apparatus shown in FIG. 10, that is, shows the rolled paper conveying control operation to be performed based on the detected result concerning the presence and the absence of the rolled paper by the spool rotation sensor mechanism within the roll folder 100.

If the recording operation is started (step S1401), it is judged whether or not the rotation of the spool 101 is detected by the spool rotation sensor mechanism within the roll folder 100 (step S1402). If the rotation of the spool 101 is not detected, the absence of the rolled paper Pr on the spool 101 is detected, and information representing such a fact is stored in the recording apparatus (step S1403).

If all the recording operations end (step S1405), it is judged whether or not the absence of the rolled paper Pr on the spool 101 has been detected previously based on the information stored in the step S1403 (step S1406). If the absence of the rolled paper Pr on the spool 101 has not been detected, the rolled paper Pr is taken up into the roll folder 100 (step S1407).

On the other hand, if the absence of the rolled paper Pr on the spool 101 has been detected in the step S1406, the printing continued after the trailing edge of the rolled paper Pr had parted from the spool 101, the trailing edge of the rolled paper Pr might be located in the downstream of the conveying path rather than the feed roller 102 of the roll folder 100. Thus, in the case where the paper is taken up in the state that the trailing edge of the rolled paper Pr is located in the downstream of the conveying path rather than the feed roller 102 of the roll folder 100, if the paper is being curled, the jam might occur because the curled paper does not well enter the feed roller 102 of the roll folder 100. Thus, in this case, the rolled paper Pr is not taken up but discharged outside the recording apparatus (step S1408).

In the ordinary cut and discharge operation of the rolled paper in the step S1103 of FIG. 11, in order to prevent the stagnation of the rolled paper Pr after the paper cut in the conveying path because of its curl, the cut rolled paper Pr is discharged by the post-cutter discharge roller 143, and concurrently the rolled paper Pr remaining in the recording apparatus is further conveyed toward the discharge direction by the conveying roller 131 to push the cut rolled paper Pr outside. However, since the rolled paper discharge operation in the step S1408 of FIG. 14 is the operation to discharge the last portion of the paper outside the recording apparatus, there is no paper in the apparatus to push the discharged paper outside. Therefore, since the last portion of the rolled paper Pr is discharged only based on the conveying force of the post-cutter discharge roller 143, there is a fear that, in the discharge of the rolled paper Pr, this paper is caught in the conveying path in the discharge unit 140 because of its curl and thus stagnates or stands. In the discharge operation, if the post-cutter discharge roller 143 is driven and the absence of the paper is detected by the discharge sensor 144, it is determined that the discharge operation ended without error. Here, when the absence of the rolled paper Pr is not detected by the discharge sensor 144 even if the post-cutter discharge roller 143 is driven for predetermined time period, it is determined that the jam in discharging occurs.

Particularly, since the last trailing edge of the rolled paper Pr is close to the paper tube, such a portion is strongly curled, whereby the fear of jam in discharging is strong.

Here, as another structural example of the recording apparatus shown in FIG. 10, there is a recording apparatus in which roll folders are arranged at upper and lower stages. In this type of recording apparatus, it is possible to store the same rolled paper in both the upper-stage roller folder and the lower-stage roll folder, and thus perform continuous recording to the rolled papers stored in the upper-stage roller folder and the lower-stage roll folder. Therefore, there is an advantage that, if an amount of ink is enough, a large amount of recording can be performed by an all-night unattended operation or the like without exchanging the rolled paper.

However, as described above, when it is intended to perform continuous recording (printing) to the rolled papers stored in the first-stage roll folder and the second-stage roll folder in due order, if the jam in discharging first occurs at the trailing edge of the rolled paper stored in the upper-stage roll folder, the recording operation is suspended, and thus the continuous recording cannot be performed to the rolled paper stored in the lower-stage roll folder, whereby a problem that the large amount of recording effectively using the plural feed stages cannot be performed occurs.

SUMMARY OF THE INVENTION

An object of the present invention is to provide a recording apparatus which can perform, without any jam in discharging, continuous recording to rolled recording materials respectively stored in roll folders of plural stages.

Another object of the present invention is to provide a recording apparatus which, in a case where absence of a rolled recording material on a supporting means in a storing means is detected during recording to the rolled recording material stored in the storing means, takes up the remaining rolled recording material to the storing means if it is designated that the recording should be performed continuously to a rolled recording material stored in another storing means.

Still another object of the present invention is to provide a recording apparatus which, in a case where two or more storing means are designated and continuous recording is performed by using the designated storing means, during the recording to a rolled recording material stored in the storing means other than the storing means designated to be used for the last time in the continuous recording, takes up the rolled recording material into the storing means and performs the continuous recording at a time when the rolled recording material on a supporting means is exhausted.

BRIEF DESCRIPTION OF THE DRAWINGS

FIG. 4 is a flow chart for explaining an example of a rolled paper conveying control operation by the recording apparatus according to the first embodiment of the present invention;

FIG. 5A shows a state that a lot of rolled paper still remains on a spool, FIG. 5B shows a state immediately before the rolled paper on the spool is exhausted, and FIG. 5C shows a state that the rolled paper on the spool is absent;

FIG. 6 is a flow chart for explaining an example of a rolled paper conveying control operation by the recording apparatus according to the second embodiment of the present invention;

FIG. 7A shows a state that a rolled paper still remains on a spool, and FIG. 7B shows a state that the rolled paper on the spool is absent;

FIG. 8 is a flow chart for explaining an example of a rolled paper conveying control operation by the recording apparatus according to the third embodiment of the present invention;

FIG. 9 is a flow chart for explaining an example of a rolled paper conveying control operation by the recording apparatus according to the fourth embodiment of the present invention;

DETAILED DESCRIPTION OF THE PREFERRED EMBODIMENTS

Hereinafter, the embodiments of the present invention will be explained with reference to the attached drawings.

A recording apparatus according to the present invention may adopt any recording system such as an ink-jet system, a thermosensitive system, an electrostatic system or the like. Further, in case of adopting the ink-jet system, it is possible to adopt either the system in which recording is performed as a recording head is reciprocated on a rolled recording material (and intermittent feed of the recording material is repeated), or the system in which recording is performed (by continuous conveying of the recording material) in the state that the recording head is being fixed. Moreover, as the rolled recording material to which various subjects such as images, characters and the like are recorded or printed, it is possible to use any kinds of materials such as a rolled recording paper, a rolled recording film and the like if they have a rolled shape.

Therefore, in the embodiments explained as follows, the ink-jet system in which the recording head records images, characters and the like to the rolled recording material as it scan-moves toward the direction intersecting the conveying direction of the rolled recording material, and the rolled recording material is intermittently conveyed by a predetermined amount if the recording of one scan is performed is applied as the recording system, and the rolled recording paper (called a rolled paper hereinafter) is used as the rolled recording material.

First Embodiment

Figure 1:
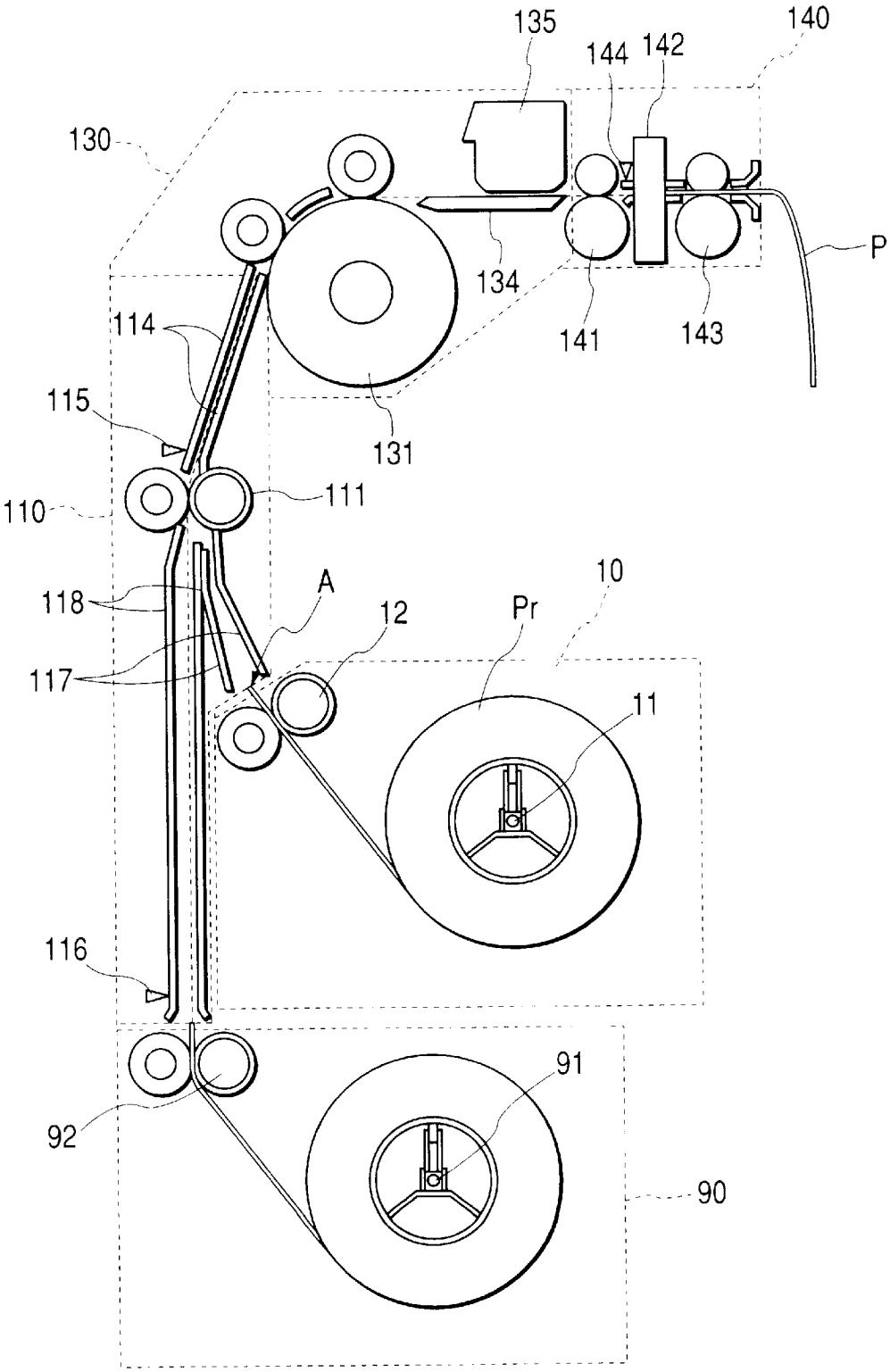
FIG. 1 is a sectional view showing a recording apparatus according to one embodiment of the present invention.

FIG. 1 is a sectional view showing a recording apparatus (paper path) according to one embodiment of the present invention.

Figure 10:
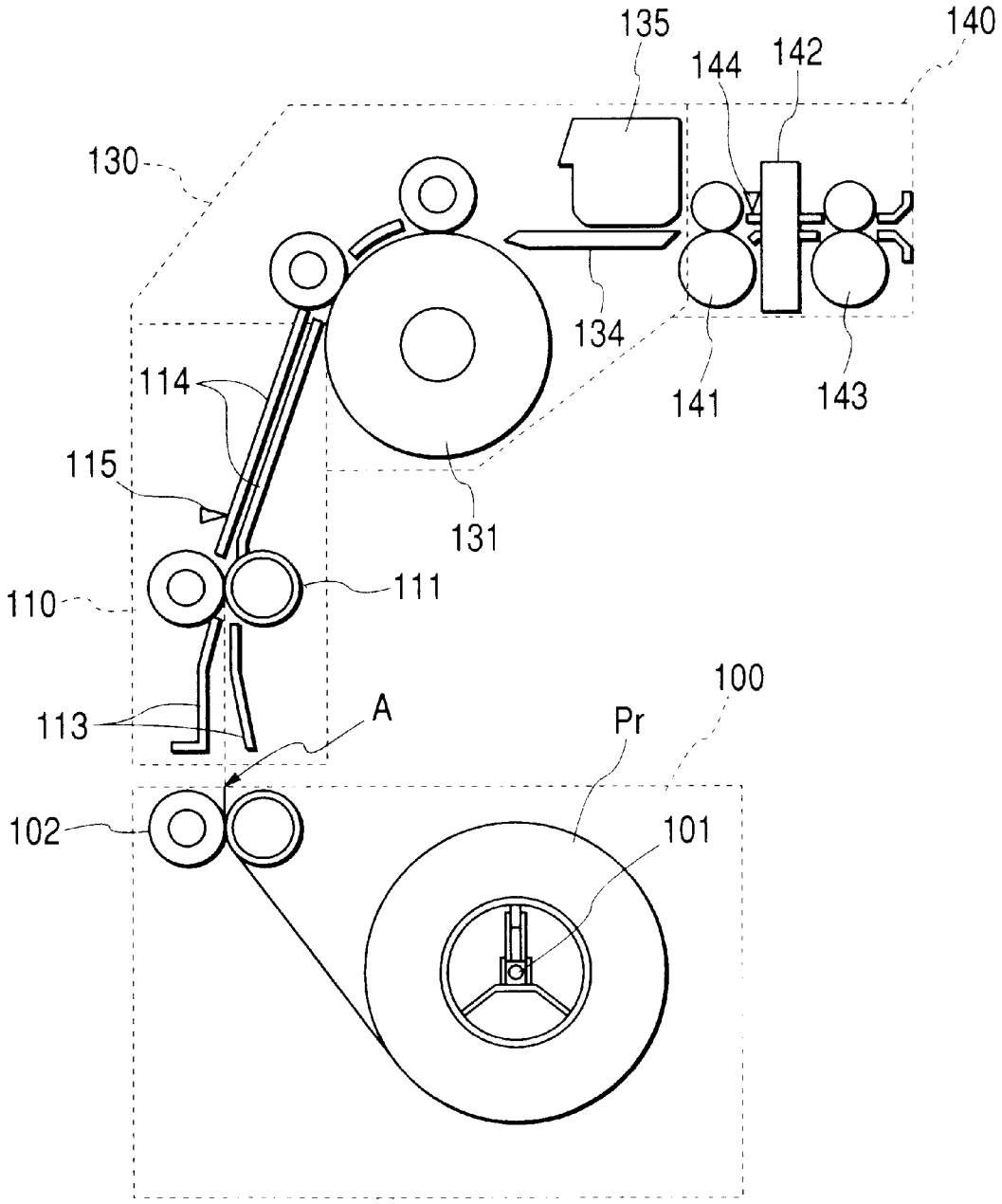
FIG. 10 is a sectional view showing a structural example of a conventional recording apparatus.
Figure 11:
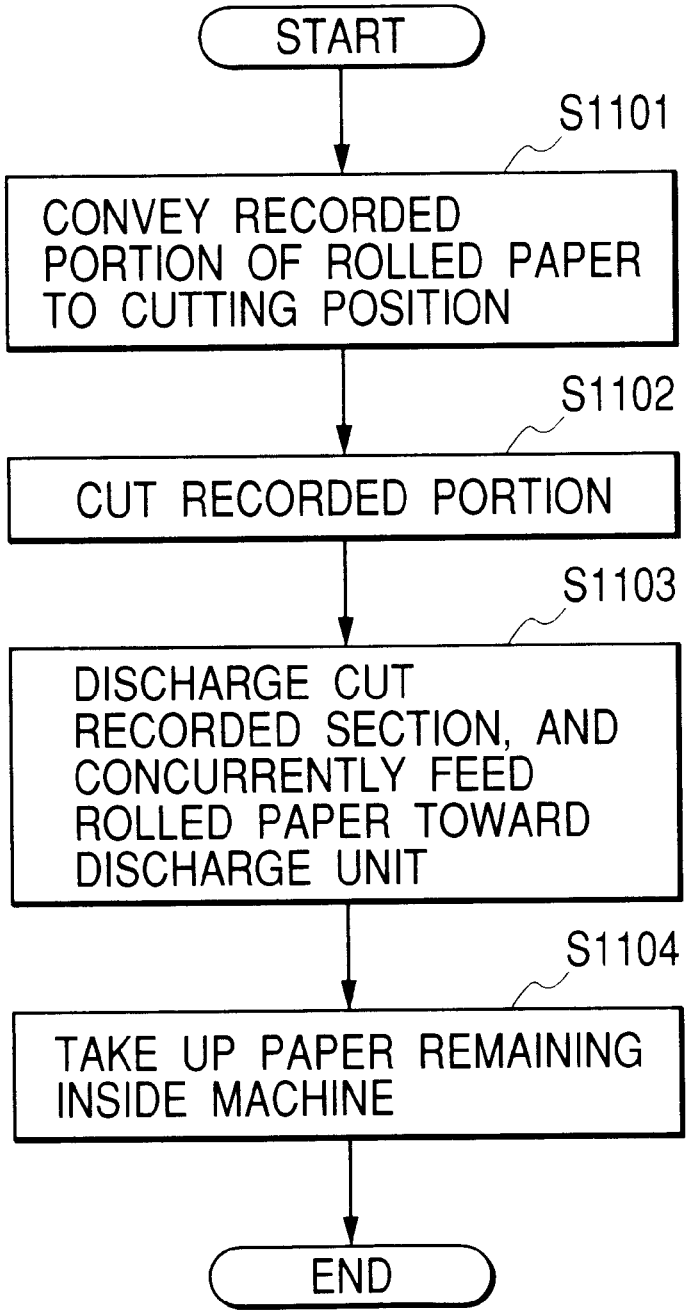
FIG. 11 is a flow chart for explaining a cut operation of a rolled paper to be performed after a recording operation ended in the recording apparatus of FIG. 10.

The recording apparatus shown in FIG. 1 is different from that shown in FIG. 10 in the point that an upper-stage roll folder (or holder) 10 and a lower-stage roll folder (or holder) 90 are arranged respectively at upper and lower stages. Thus, the recording apparatus shown in FIG. 1 has an advantage that a same rolled paper Pr is stored in each of the upper-stage roll folder 10 and the lower-stage roll folder 90, and the continuous recording is performed to the rolled papers Pr stored in the roll folders 10 and 90, whereby the large amount of recording can be performed without exchanging the rolled paper. It should be noted that, in FIG. 1, the same parts as those shown in FIG. 10 are added with the same reference numerals and symbols, and the explanations thereof are omitted.

In the upper-stage roll folder 10, a spool 11 acting as a supporting member is passed inside the paper tube of the rolled paper Pr, and the spool 11 and the paper tube are fixed to each other, whereby the rolled paper Pr is rotatably supported by the spool 11. Moreover, the leading edge (A in FIG. 1) of the rolled paper Pr is set as being nipped by an upper-stage feed roller 12, and the rolled paper Pr is then conveyed up to a conveying roller 111 by the conveying force of the upper-stage feed roller 12 and the guiding of a pair of conveying guides 117.

Similarly, in the lower-stage roll folder 90, the rolled paper Pr is rotatably supported from the inside of its paper tube by a spool 91 acting as a supporting member, the leading edge of the rolled paper Pr is set as being nipped by a lower-stage feed roller 92, and the rolled paper Pr is then conveyed up to the conveying roller 111 by the conveying force of the lower-stage feed roller 92 and the guiding of a pair of conveying guides 118. The spools 11 and 91 are not driven by the motive force of a motor or the like but are rotated according to the feed rollers 12 or 92 respectively when the rolled paper Pr is conveyed, while the spools 11 and 91 are driven by the motive force of a not-shown motor or the like when the rolled paper Pr is taken up. The conveying roller 111, a conveying roller 131, the upper-stage feed roller 12, and the lower-stage feed roller 92 are together called a conveying means or unit. Incidentally, an in-path rolled paper sensor 116 which detects presence and absence of the rolled paper Pr under conveying is provided in the conveying path of the pair of the conveying guides 118.

Figure 12:
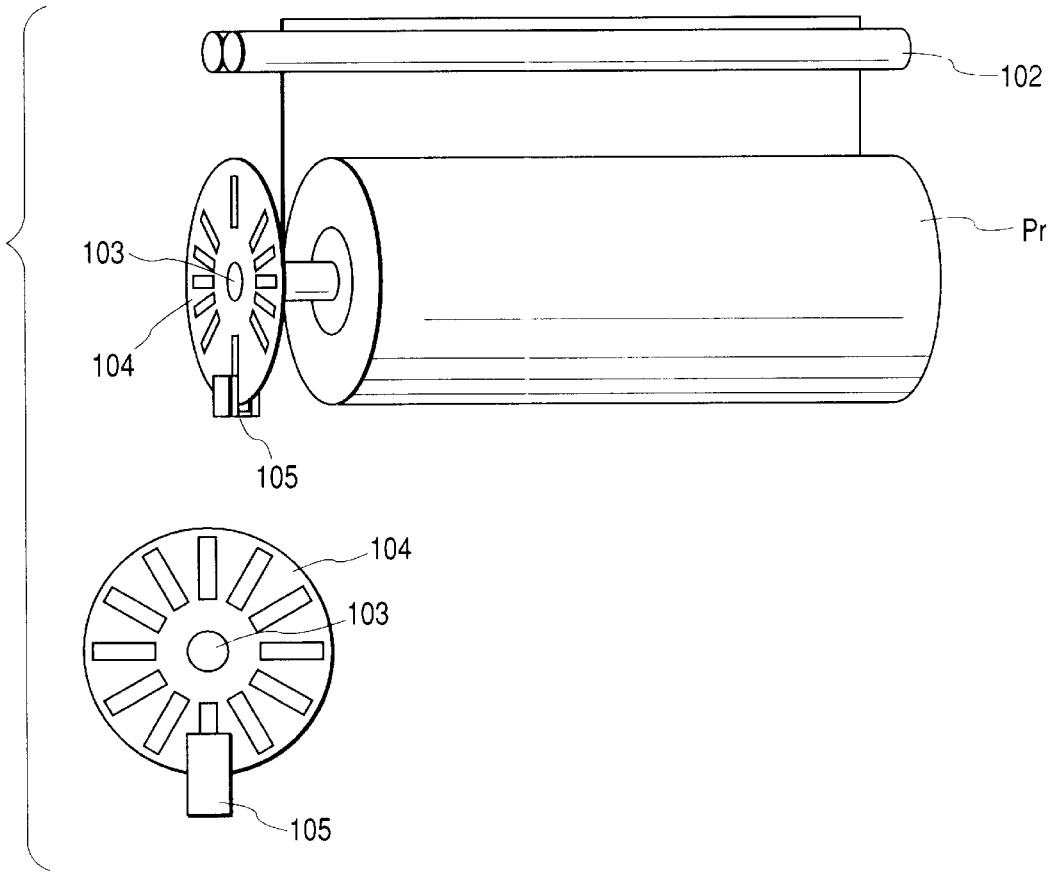
FIG. 12 is a view showing an example of a spool rotation sensor mechanism within a roll folder shown in FIG. 10.
Figure 13:
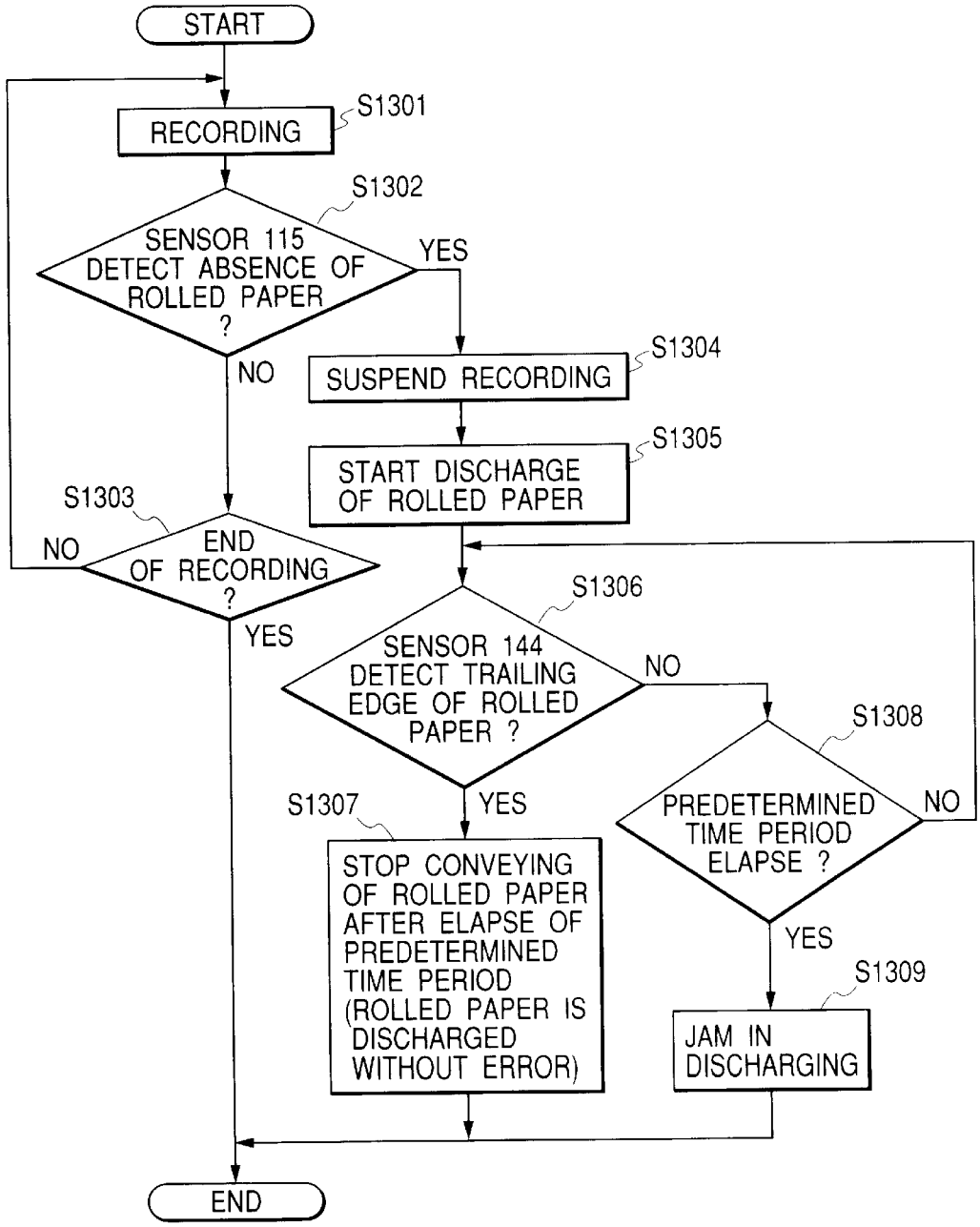
FIG. 13 is a flow chart for explaining an example of a rolled paper conveying control operation by the recording apparatus shown in FIG. 10.

Each of the upper-stage roll folder 10 and the lower-stage roll folder 90 is made drawable independently to this side of the apparatus (the right in FIG. 1), so that the rolled paper Pr can be easily exchanged. Further, a feed detecting means or member which detects the presence and the absence of the rolled paper Pr on the spool is provided in each of the upper-stage roll folder 10 and the lower-stage roll folder 90. In the present embodiment, it is assumed that the spool rotation sensor mechanism as shown in FIG. 12 is provided as the feed detecting means in each of the upper-stage roll folder 10 and the lower-stage roll folder 90.

If the rolled paper Pr is set on the upper stage or the lower stage, the upper-stage feed roller 12 or the lower-stage feed roller 92 is driven to automatically feed the paper. At this time, if the rolled paper Pr is set, the set rolled paper is drawn by the driving of the upper-stage feed roller 12 or the lower-stage feed roller 92, and the spool is rotated accordingly, whereby the presence of the paper is detected by the spool rotation sensor mechanism. If there is no paper, the rotation of the spool is not detected even if the upper-stage feed roller 12 or the lower-stage feed roller 92 is driven for a predetermined time period, whereby it is determined that the paper is not set.

Figure 2:
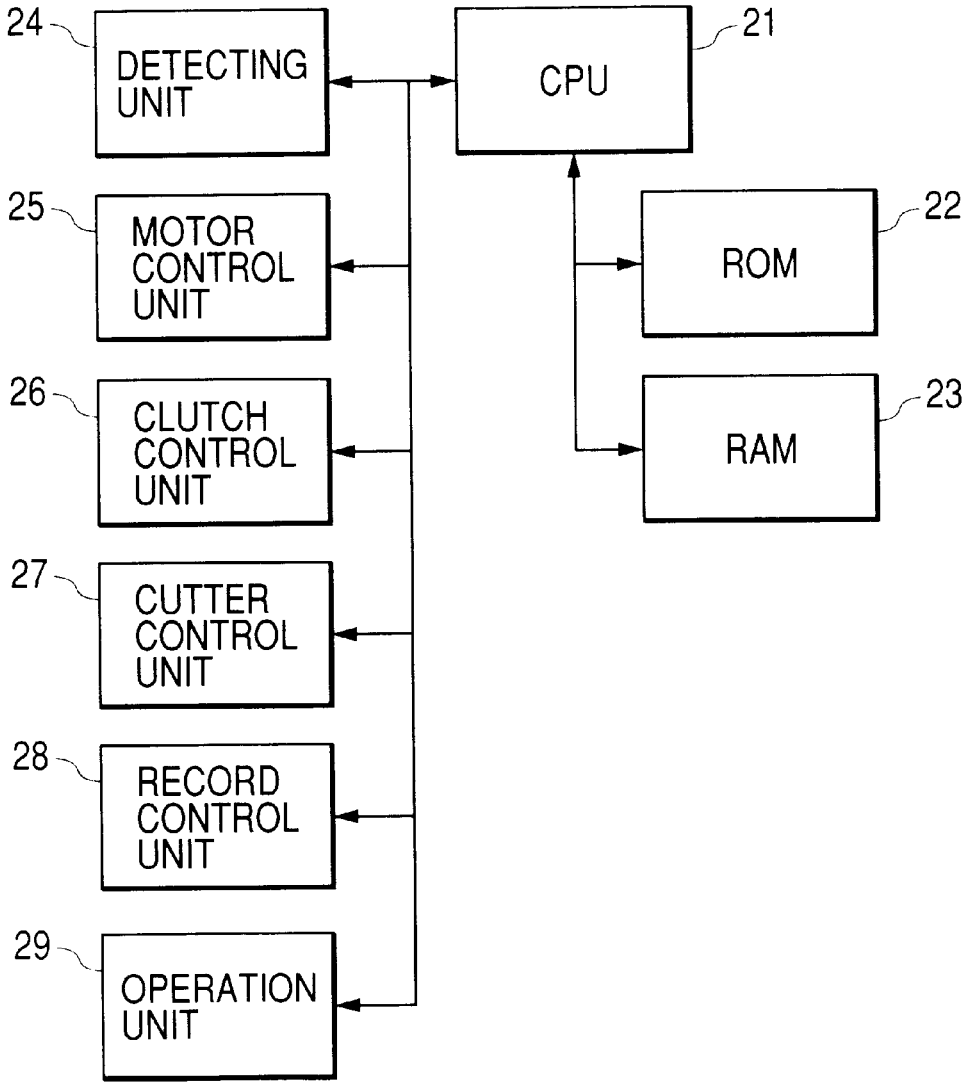
FIG. 2 is a block diagram showing an example of the hardware structure of the recording apparatus shown in FIG. 1.

FIG. 2 is a block diagram showing an example of the hardware structure of the recording apparatus shown in FIG. 1. In FIG. 2, a CPU 21 acting as a control means performs various control in the recording apparatus, according to programs stored in a ROM 22.

Concretely, the CPU 21 discriminates a sensor input signal from a detecting unit 24, and performs rolled paper conveying control by controlling a motor control unit 25, a clutch control unit 26, a cutter control unit 27 and a record control unit 28 based on the discriminated signal.

A RAM 23 is a means for temporarily storing information. Here, the detecting unit 24 is a generic means which is composed of in-path rolled paper sensors 115 and 116, a discharge sensor 144, and the feed detecting means respectively provided in the roll folders 10 and 90.

The motor control unit 25 controls motors (not shown) driving the spools 11 and 91, the conveying rollers 111 and 131, a pre-cutter discharge roller 141 and a post-cutter discharge roller 143. The clutch control unit 26 controls a clutch (not shown) which couples the motor controlled by the motor control unit 25, the spools 11 and 91, the conveying rollers 111 and 131, the pre-cutter discharge roller 141 and the post-cutter discharge roller 143 together. Here, a driving means is composed of the motors controlled by the motor control unit 25 and the clutch controlled by the clutch control unit 26. The cutter control unit 27 controls a cutter 142, the record control unit 28 performs record control of a recording head 135, and an operation unit 29 displays the states of the recording apparatus and is used to perform setting input of the recording apparatus.

Figure 3:
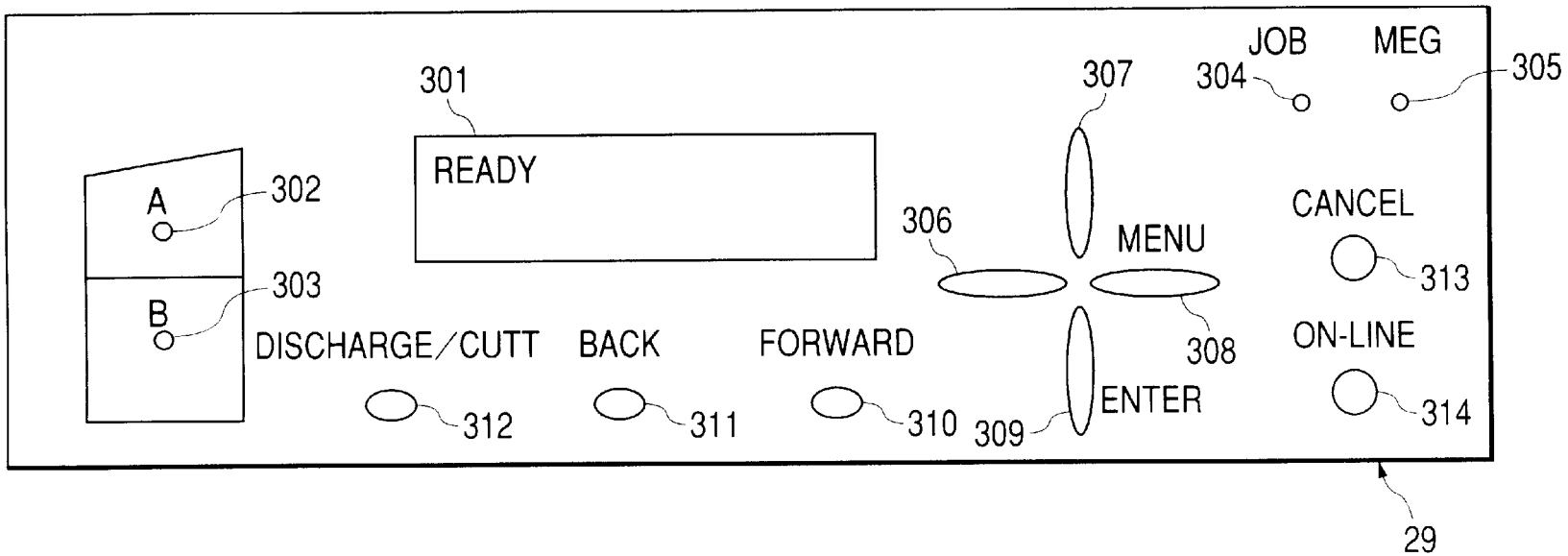
FIG. 3 is a view showing an example of an operation unit shown in FIG. 2.

FIG. 3 is a view showing an example of the operation unit 29 shown in FIG. 2. As shown in FIG. 3, for example, the operation unit 29 is composed of an LCD (liquid crystal display) unit 301 and LED (light-emitting diode) display units 302 to 305 which display the states of the recording apparatus, and keys 306 to 314 by which the setting input of the recording apparatus is performed.

Through the operation unit 29, a user of the recording apparatus designates the upper/lower-stage continuous recording for continuously or successively performing the recording to the rolled papers Pr stored in both the upper-stage roll folder 10 and the lower-stage roll folder 90, order of the rolled papers Pr used in the continuous recording, ordinary recording for performing the recording to the rolled paper Pr stored in either the upper-stage roll folder 10 or the lower-stage roll folder 90, and the like.

Moreover, if the absence of the rolled paper Pr is detected, the user of the recording apparatus can designate, through the operation unit 29, a conveying method for discharging the remaining rolled paper Pr outside the apparatus or taking up it into the roll folder.

Hereinafter, the rolled paper conveying control operation by the recording apparatus structured as above will be explained with reference to a flow chart shown in FIG. 4.

FIG. 4 is the flow chart for explaining an example of the rolled paper conveying control operation by the recording apparatus according to the first embodiment of the present invention. In the following explanation, it is assumed that the user of the recording apparatus designates the upper/lower-stage continuous recording in which the upper-stage recording to the rolled paper Pr stored in the upper-stage roll folder 10 is first performed and the lower-stage recording to the rolled paper Pr stored in the lower-stage roll folder 90 is then performed.

If the recording operation is started (step S401), it is judged whether or not the rotation of the spool is detected by the spool rotation sensor mechanism within the roll folder (step S402). If the rotation of the spool is detected, it is determined that the rolled paper Pr is present on the spool, and the process advances to a step S405 through steps S403 and S404.

On the other hand, if the rotation of the spool is not detected in the step S402, it is determined that the rolled paper Pr is absent on the spool 101, and information representing such a fact is temporarily stored in the recording apparatus (step S406).

Next, it is judged whether or not the upper-stage recording in the upper/lower-stage continuous recording is being performed (step S407). If the upper-stage recording is being performed, the recording operation is suspended (step S412), the rolled paper Pr is cut by the cutter 142 at the suspended position (step S413), and the remaining rolled paper Pr is taken up into the upper-stage roll folder 10 (step S405). Therefore, if the conveying method for discharging the remaining rolled paper Pr outside the recording apparatus has been designated through the operation unit 29 as the conveying method in the case where the absence of the rolled paper Pr is detected, such the already-designated method is changed to the conveying method for taking up the remaining rolled paper Pr into the upper-stage roll folder 10. After then, the recording is continued to the rolled paper Pr stored in the lower-stage roll folder 90.

The state of a discharge unit 140 when the process in the step S405 ends will be explained with reference to FIG. 1. It should be noted that FIG. 1 shows the state of the discharge unit 140 in a case where the rolled paper Pr is especially strongly curled and thus the rolled paper Pr cut by the cutter 142 (this cut rolled paper Pr is called a sheet P hereinafter) stagnates or stands in the discharge unit 140.

The sheet P cut by the cutter 142 is conveyed and discharged outside the apparatus by the post-cutter discharge roller 143. However, as shown in FIG. 1, the sheet P might stagnate at the position of the post-cutter discharge roller 143. On one hand, since the discharge sensor 144 is located on the upstream side of the cutter 142, the sheet P does not stagnate at the discharge sensor 144 if the rolled paper Pr is taken up after the cutting. Thus, it is determined that the discharge operation of the sheet P completed without terror, whereby it becomes possible to continue the recording to the rolled paper Pr stored in the lower-stage roll folder 90. Even if the sheet P stagnates at the position of the post-cutter discharge roller 143 as described above, the next rolled paper Pr (i.e., the rolled paper Pr set in the lower-stage roll folder 90) is conveyed and thus pushes the sheet P as assistance of the conveying, whereby the sheet P can be discharged outside.

As above, in the case where the absence of the rolled paper Pr is detected by the spool rotation sensor mechanism during the upper-stage recording in the upper/lower-stage continuous recording, if the rolled paper Pr is taken up into the upper-stage roll folder 10, the occurrence factor of the jam in discharging is eliminated. Thus, the recording apparatus can continue the upper/lower-stage continuous recording without suspending it even if the jam in discharging occurs.

However, on one hand, since the rolled paper Pr is taken up into the upper-stage roll folder 10 in the state that the rolled paper Pr still remains in the conveying path between the spool 11 and the cutter 142, a defect that the useless rolled paper Pr to which any recording is not performed remains in the upper-stage roll folder 10 occurs.

Therefore, if it is judged in the step S407 that the upper-stage recording in the upper/lower-stage continuous recording is not being performed, then it is further judged whether or not the absence of the rolled paper Pr is detected by the in-path rolled paper sensor 115 (step S408). Next, the process advances to a step S409 if the absence of the rolled paper Pr is detected, while the process advances to the step S403 to continue the recording if the absence of the rolled paper Pr is not detected.

In the step S409, a remaining amount of the rolled paper Pr is compared with a remaining amount of the image or the like. Then, if it is determined based on the compared result that the remaining image or the like can be recorded by the remaining amount of the rolled paper Pr, the process advances to the step S403 to continue the recording.

On the other hand, if it is determined based on the compared result in the step S409 that the remaining image or the like can not be recorded by the remaining amount of the rolled paper Pr, the recording operation is suspended (step S410), and the rolled paper Pr is discharged outside the apparatus (step S411). Therefore, if the conveying method for taking up the remaining rolled paper Pr into the lower-stage roll folder 90 has been designated through the operation unit 29 as the conveying method of the remaining paper Pr in the case where the absence of the rolled paper Pr is detected, such the already-designated method is changed to the conveying method for discharging the remaining rolled paper Pr outside the recording apparatus.

As above, if the absence of the rolled paper Pr is detected by the spool rotation sensor mechanism during the lower-stage recording in the upper/lower-stage continuous recording, it is possible to prevent a waste of the rolled paper Pr and effectively use the rolled paper Pr.

In the step S403, it is judged whether or not the recording ends. Then, the process returns to the step S401 if the recording does not end, while the process advances to the step S404 if the recording ends.

In the step S404, it is judged whether or not the absence of the rolled paper Pr on the spool has been detected previously based on the information stored in the step S406. If the absence of the rolled paper Pr on the spool has not been detected, the process advances to the step S405 to take up the rolled paper Pr into the roll folder. On the other hand, if the absence of the rolled paper Pr on the spool has been detected, the process advances to the step S411 to discharge the rolled paper Pr outside the apparatus.

As described above, in the present embodiment, if the absence of the rolled paper Pr on the spool 11 in the upper-stage roll folder 10 is detected during the upper-stage recording in the upper/lower-stage continuous recording, the rolled paper Pr is cut at that position, and the remaining rolled paper Pr is taken up.

Therefore, the waste of the rolled paper occurs during the upper-stage recording in the upper/lower-stage continuous recording. However, it is possible to prevent that the recording is suspended or stopped due to the jam in discharging when the rolled paper Pr on the spool 11 in the upper-stage roll folder 10 is exhausted, and thus maintain the upper/lower-stage continuous recording.

On the other hand, if the absence of the rolled paper Pr on the spool 91 in the lower-stage roll folder 90 is detected during the lower-stage recording in the upper/lower-stage continuous recording, the recording is performed to the remaining portion of the rolled paper Pr as much as possible on the basis of the detected result by the in-path rolled paper sensor concerning the presence/absence of the rolled paper Pr, and then the rolled paper Pr is discharged outside the apparatus.

Therefore, even in the upper/lower-stage continuous recording, the waste of the rolled paper can be prevented if the upper-stage recording is not being performed. Moreover, if the ordinary recording is performed after designating either one of the upper-stage roll folder 10 and the lower-stage roll folder 90, the judged result "NO" is obtained in the step S407 of FIG. 4, and the process in and after the step S408 is then performed, whereby the waste of the rolled paper can be prevented. When the last rolled paper Pr in the recording apparatus is discharged, it is assumed that the rolled paper Pr stagnates or stands in the discharge unit 140, the jam in discharging is detected by the discharge sensor 144, and the recording apparatus stops. However, even in such a case, any problem does not occur because the rolled paper to which the recording can be performed is not present within the recording apparatus. The user only has to eliminate the stagnated rolled paper from the recording apparatus.

In the present embodiment, the structure including the roll folders of two stages is explained. However, the present invention can adopt the structure including the roll folders of three or more stages.

For example, it is assumed that the roll folders are provided respectively at the upper, middle and lower stages. Then, in a case where the continuous recording is performed in order of the upper, middle and lower stages, if absence of the rolled paper on the spool is detected during the upper-stage recording and the middle-stage recording in the continuous recording, the process in and after the step S412 (FIG. 4) is performed. On the other hand, if absence of the rolled paper on the spool is detected during the lower-stage recording in the continuous recording, the process in and after the step S408 (FIG. 4) is performed.

Therefore, also in case of performing the continuous recording in the order of the upper, middle and lower stages, it is possible to prevent during the upper-stage recording and the middle-stage recording in the continuous recording that the continuous recording is suspended due to a jam in discharging when the rolled paper on the spool 10 is exhausted. Moreover, it is possible to prevent during the lower-stage recording that the rolled paper is wasted.

Further, the present embodiment explains that, if the user of the recording apparatus designates the upper/lower-stage continuous recording, he designates to first perform the upper-stage recording and then perform the lower-stage recording. However, according to the present invention, the user can designate to first perform the lower-stage recording and then perform the upper-stage recording in the designation of the upper/lower-stage continuous recording.

In the case where the user designates the upper/lower-stage continuous recording to first perform the lower-stage recording and then perform the upper-stage recording, if absence of the rolled paper on the spool is detected during the lower-stage recording of the continuous recording, the process in and after the step S412 (FIG. 4) is performed. On the other hand, if absence of the rolled paper on the spool is detected during the upper-stage recording of the continuous recording, the process in and after the step S408 (FIG. 4) is performed.

Therefore, also in the case where the user designates the upper/lower-stage continuous recording to first perform the lower-stage recording and then perform the upper-stage recording, it is possible to prevent during the lower-stage recording of the continuous recording that the continuous recording is suspended due to a jam in discharging when the rolled paper on the spool is exhausted. Moreover, it is possible to prevent during the upper-stage recording that the rolled paper is wasted.

Second Embodiment

Figure 5A:
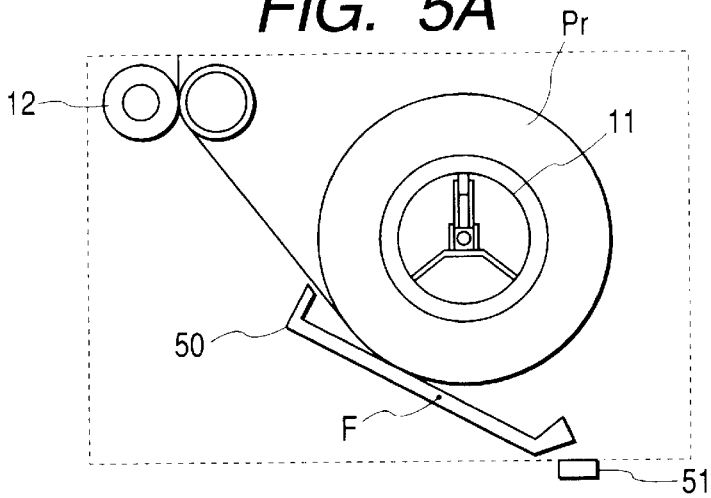
FIGS. 5A, 5B and 5C are views showing a structural example of a feed detecting means in a roll folder used in the recording apparatus according to the second embodiment of the present invention, particularly.
Figure 5B:
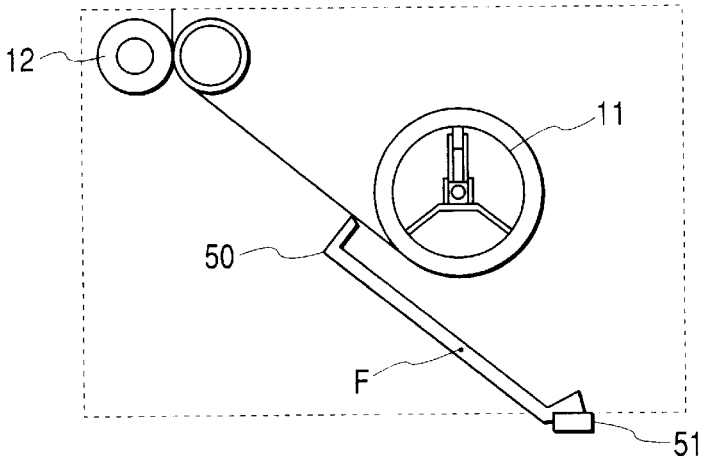
Figure 5C:
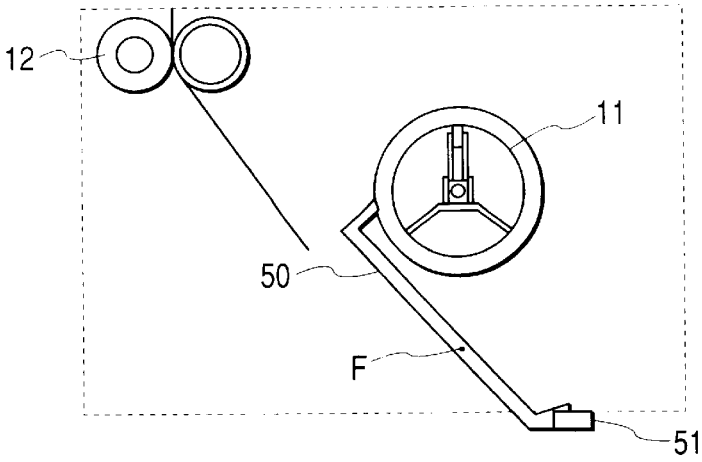

FIGS. 5A, 5B and 5C are views showing a structural example of a feed detecting means in the roll folder used in the recording apparatus according to the second embodiment of the present invention. That is, FIG. 5A shows a state that a lot of rolled paper still remains on the spool, FIG. 5B shows a state immediately before the rolled paper on the spool is exhausted, and FIG. 5C shows a state that the rolled paper on the spool is absent. It should be noted that, although FIGS. 5A to 5C show the feed detecting means in the upper-stage roll folder 10 of FIG. 1, the feed detecting means in the lower-stage roll folder 90 has the same structure as that of the upper-stage roll folder 10.

The second embodiment is different from the first embodiment in the point that, in the roll folder 10 or 90, presence and absence of a rolled paper Pr are detected by using a rolled paper detecting lever sensor 51 which detects a rolled paper detecting lever 50.

In FIGS. 5A to 5C, the rolled paper detecting lever 50 is the lever which rotates around a fulcrum F and of which the right in the drawing is made heavy. Therefore, the left of the fulcrum F applies force to the rolled paper Pr or the paper tube thereof according to the remaining amount of the rolled paper Pr.

The rolled paper detecting lever sensor 51 is the sensor which detects the rolled paper detecting lever 50 when the rolled paper Pr on a spool 11 is exhausted.

When a lot of rolled paper Pr still remains on the spool 11 (FIG. 5A), the rolled paper detecting lever 50 is not detected by the rolled paper detecting lever sensor 51, whereby it is determined that the rolled paper Pr is present. Further, in the state immediately before the rolled paper Pr on the spool 11 is exhausted (FIG. 5B), since the rolled paper detecting lever 50 applies force to the rolled paper Pr which is being fed between an upper-stage feed roller 12 and the spool 11, the rolled paper detecting lever 50 is not detected by the rolled paper detecting lever sensor 51, whereby it is determined that the rolled paper Pr is present.

On the other hand, if the rolled paper Pr on the spool 11 is exhausted (FIG. 5C), the rolled paper detecting lever 50 applies force to the spool 11, whereby the rolled paper detecting lever 50 is detected by the rolled paper detecting lever sensor 51, and it is thus determined that the rolled paper Pr is absent.

FIG. 6 is a flow chart for explaining an example of a rolled paper conveying control operation by the recording apparatus according to the second embodiment of the present invention. In the following explanation, it is assumed that the user of the recording apparatus designates the upper/lower-stage continuous recording in which the upper-stage recording to the rolled paper Pr stored in the upper-stage roll folder 10 is first performed and the lower-stage recording to the rolled paper Pr stored in the lower-stage roll folder 90 is then performed.

If the recording operation is started (step S601), it is judged whether or not the absence of the rolled paper is detected by the rolled paper detecting lever sensor in the roll folder (step S602). If the absence of the rolled paper is not detected, the process advances to a step S603, while if the absence of the rolled paper is detected, the process advances to a step S606.

Incidentally, the operation to be performed in and after the step S603 is the same as the operation to be performed in and after the step S403 of FIG. 4, and the operation to be performed in and after the step S606 is the same as the operation to be performed in and after the step S406 of FIG. 4.

Third Embodiment

Figure 7A:
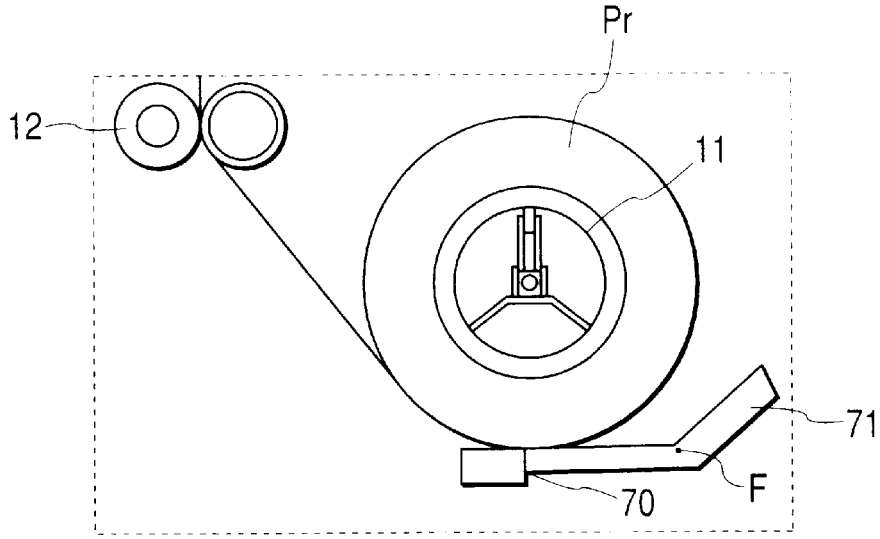
FIGS. 7A and 7B are views showing a structural example of a feed detecting means in a roll folder used in the recording apparatus according to the third embodiment of the present invention, particularly.
Figure 7B:
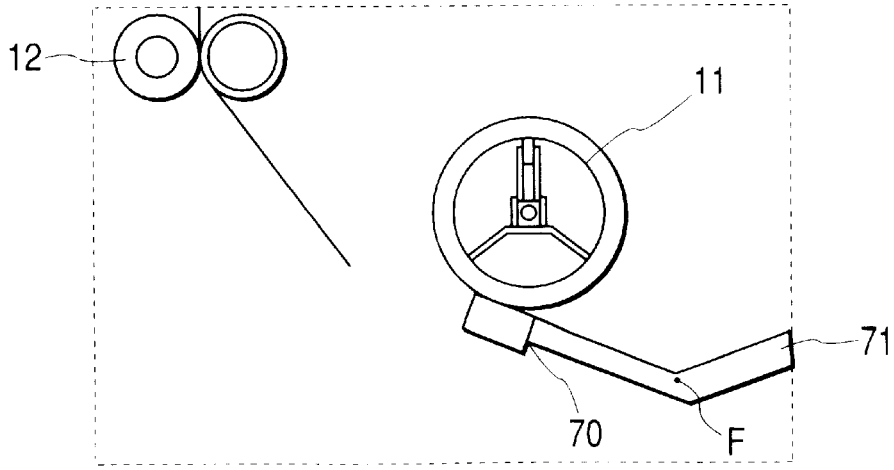

FIGS. 7A and 7B are views showing a structural example of a feed detecting means in the roll folder used in the recording apparatus according to the third embodiment of the present invention. That is, FIG. 7A shows a state that the rolled paper still remains on a spool 11, and FIG. 7B shows a state that the rolled paper on the spool 11 is absent. It should be noted that, although FIGS. 7A and 7B show the feed detecting means in the upper-stage roll folder 10 of FIG. 1, the feed detecting means in the lower-stage roll folder 90 has the same structure as that of the upper-stage roll folder 10.

The third embodiment is different from the first embodiment in the point that, in the roll folder 10 or 90, presence and absence of a rolled paper Pr are detected by using a rolled paper spool color sensor 70 which discriminatingly detects a color (white) of the rolled paper Pr in a case where the rolled paper Pr is present on the spool and a color (unwhite) of the paper tube of the rolled paper Pr in a case where the rolled paper Pr is absent on the spool.

In FIGS. 7A and 7B, a rolled paper color detecting lever 71 is the lever which rotates around a fulcrum F and of which the right in the drawing is made heavy. Therefore, the left of the fulcrum F applies force to the rolled paper Pr or the paper tube thereof according to the remaining amount of the rolled paper Pr.

The rolled paper spool color sensor 70 is coupled to one end of the rolled paper color detecting lever 71 so that the lever 71 applies force to the rolled paper Pr or the paper tube thereof, whereby the color of the rolled paper Pr or the paper tube thereof is detected by the rolled paper spool color sensor 70.

If the rolled paper Pr still remains on the spool 11 (FIG. 7A), white of the rolled paper Pr is detected by the rolled paper spool color sensor 70, whereby it is determined that the rolled paper Pr is present. On the other hand, if the rolled paper Pr on the spool 11 is exhausted (FIG. 7B), the color (unwhite) of the paper tube of the rolled paper Pr is detected by the rolled paper spool color sensor 70, whereby it is determined that the rolled paper Pr is absent.

FIG. 8 is a flow chart for explaining an example of the rolled paper conveying control operation by the recording apparatus according to the third embodiment of the present invention. In the following explanation, it is assumed that the user of the recording apparatus designates the upper/lower-stage continuous recording in which the upper-stage recording to the rolled paper Pr stored in the upper-stage roll folder 10 is first performed and the lower-stage recording to the rolled paper Pr stored in the lower-stage roll folder 90 is then performed.

If the recording operation is started (step S801), it is judged whether or not the absence of the rolled paper is detected by the rolled paper spool color sensor in the roll folder (step S802). If the absence of the rolled paper is not detected, the process advances to a step S803, while if the absence of the rolled paper is detected, the process advances to a step S806.

Incidentally, the operation to be performed in and after the step S803 is the same as the operation to be performed in and after the step S403 of FIG. 4, and the operation to be performed in and after the step S806 is the same as the operation to be performed in and after the step S406 of FIG. 4.

Fourth Embodiment

FIG. 9 is a flow chart for explaining an example of a rolled paper conveying control operation by the recording apparatus according to the fourth embodiment of the present invention. In the following explanation, it is assumed that the user of the recording apparatus designates the upper/lower-stage continuous recording in which the upper-stage recording to the rolled paper Pr stored in the upper-stage roll folder 10 is first performed and the lower-stage recording to the rolled paper Pr stored in the lower-stage roll folder 90 is then performed.

The structure itself of the recording apparatus according to the fourth embodiment is the same as that of the recording apparatus according to the first embodiment. However, the fourth embodiment is different from the first embodiment in the point that, in a case where absence of the rolled paper Pr on the spool 11 in the upper-stage roll folder 10 is detected during the upper-stage recording of the continuous recording, if absence of the rolled paper Pr in the lower-stage roll folder 90 by which the recording is to be performed successively is detected, it is suspended to take up the rolled paper Pr into the upper-stage roll folder 10.

In FIG. 9, the processes from a step S901 to a step S913 are the same as those from the step S401 to the step S413 of FIG. 4.

If it is determined that the upper-stage recording of the upper/lower-stage continuous recording is being performed in the step S907, then it is judged whether the rolled paper Pr is present in the roll folder (i.e., the lower-stage roll folder 90 in this case) by which the recording is to be performed successively (step S914).

If it is judged in the step S914 that the rolled paper Pr is present in the lower-stage roll folder 90, it is determined that the continuous recording can be performed, whereby the process advances to the step S912. On the other hand, if it is judged that the rolled paper Pr is absent in the lower-stage roll folder 90, the process advances to the step S903 to prevent a waste of the rolled paper Pr, and the recording is continued.

As described above, according to the present embodiment, in the case where the absence of the rolled paper Pr on the spool 11 in the upper-stage roll folder 10 is detected during the upper-stage recording of the upper/lower-stage continuous recording, if the absence of the rolled paper Pr in the lower-stage roll folder 90 by which the recording is to be performed successively is detected, it is suspended to take up the rolled paper Pr into the upper-stage roll folder 10, the recording is performed to the remaining portion of the rolled paper Pr as much as possible, and then the rolled paper Pr is discharged outside the apparatus.

Therefore, the rolled paper on which the recordable portion remains is not taken up into the upper-stage roll folder 10 on the way, whereby the waste of the rolled paper can be prevented.

As explained above, according to the present embodiment, in the case where the absence of the rolled recording material on the supporting means provided in the storing means is detected during the recording to the rolled recording material stored in the storing means, it is controlled to determine whether the remaining rolled recording material should be discharged outside the recording apparatus or taken up into the storing means according to whether or not it is designated that the recording should be performed continuously or successively to the rolled recording material stored in another storing means. Thus, if it is designated that the recording should be performed continuously to the rolled recording material stored in another storing means, the remaining rolled recording material is taken up into the storing means.

Therefore, in the case where the two or more storing means are designated and thus the continuous recording is performed by using these storing means, while the recording which uses the storing means not designated to be used for the last time in the continuous recording is being performed, the rolled recording material is not discharged outside when the rolled recording material on the supporting means is exhausted, whereby it is possible to provide the recording apparatus which performs the continuous recording without causing any jam in discharging.

Moreover, according to the present embodiment, if it is not designated that the recording should be performed continuously to the rolled recording material stored in another storing means, the recording is continued until the absence of the rolled recording material in the conveying path is detected. Then, after the absence of the rolled recording material in the conveying path was detected, the recording is continued according to the remaining amount of the rolled recording material, and the remaining rolled recording material is discharged outside the recording apparatus after the recording ended.

Therefore, in the case where the two or more storing means are designated and thus the continuous recording is performed by using the designated storing means, the waste of the rolled recording material can be prevented while the recording which uses the storing means designated to be used for the last time in the continuous recording is being performed. Moreover, it is possible to provide the recording apparatus by which the waste of the rolled recording material can be prevented even in the case where the one storing means is designated and the recording is performed by using the designated one storing means.

What is claimed is:

1. A recording apparatus which records an image on a rolled recording material by using recording means, comprising:

plural storing units for storing the rolled recording materials;

a supporting member for supporting, in said storing unit, the rolled recording material in a rotatable state;

a feed detecting member for detecting presence and absence of the rolled recording material on said supporting member;

a discharge unit for cutting and discharging outside said recording apparatus the rolled recording material to which the recording was performed by said recording means;

a conveying unit capable of conveying the rolled recording material toward a direction forwarding from said storing unit to said recording means or its opposite direction;

an operation unit for designating one or more storing unit from among said plural storing units, and designating order of the storing units when two or more storing units are designated; and control means for causing said conveying unit to convey the rolled recording materials stored in said storing unit in the order designated by said operation unit and said recording means to perform the recording to the conveyed rolled recording material, and for performing, in a case where the absence of the rolled recording material on said supporting member is detected by said feed detecting member during the recording, control as to whether the rolled recording material being present in said conveying unit should be discharged outside said recording apparatus or returned to said storing unit according to whether or not it is designated through said operation unit that the recording should be performed continuously to the rolled recording material stored in another storing unit.

2. A recording apparatus according to claim 1, wherein said control means returns, in the case where the absence of the rolled recording material on said supporting member is detected by said feed detecting member during the recording, the rolled recording material being present in said conveying unit to said storing unit if it is designated through said operation unit that the recording should be performed continuously to the rolled recording material stored in another storing unit.

3. A recording apparatus according to claim 1, wherein said control means discharges, in the case where the absence of the rolled recording material on said supporting member is detected by said feed detecting member during the recording, the rolled recording material being present in said conveying unit outside said recording apparatus if it is not designated through said operation unit that the recording should be performed continuously to the rolled recording material stored in another storing unit.

4. A recording apparatus according to claim 1, wherein said control means discharges, in the case where the absence of the rolled recording material on said supporting member is detected by said feed detecting member during the recording, the rolled recording material being present in said conveying unit outside said recording apparatus even if it is designated through said operation unit that the recording should be performed continuously to the rolled recording material stored in another storing unit, when it is detected by said feed detecting member that the rolled recording material is not stored in said designated storing unit.

5. A recording apparatus according to claim 1, further comprising an in-path detecting member for detecting whether or not the rolled recording material is present in a conveying path of said conveying unit, wherein, in the case where the absence of the rolled recording material on said supporting member is detected by said feed detecting member during the recording, if it is not designated through said operation unit that the recording should be performed continuously to the rolled recording material stored in another storing unit, said control means continues the recording until it is detected by said in-path detecting member that the rolled recording material is not present in said conveying path, determines whether or not the recording should be continued according to a remaining amount of the rolled recording material and an amount of the rolled recording material necessary for the recording, and discharges the rolled recording material outside said recording apparatus after the recording ended.

6. A recording apparatus according to claim 1, further comprising an in-path detecting member for detecting whether or not the rolled recording material is present in a conveying path of said conveying unit, wherein, in the case where the absence of the rolled recording material on said supporting member is detected by said feed detecting member during the recording, even if it is designated through said operation unit that the recording should be performed continuously to the rolled recording material stored in another storing unit, when it is detected by said feed detecting member that the rolled recording material is not stored in said designated storing unit, said control means continues the recording until it is detected by said in-path detecting member that the rolled recording material is not present in said conveying path, determines whether or not the recording should be continued according to a remaining amount of the rolled recording material and an amount of the rolled recording material necessary for the recording when it is detected by said in-path detecting member that the rolled recording material is not present, and discharges the rolled recording material outside said recording apparatus after the recording ended.

7. A recording apparatus according to claim 1, wherein said feed detecting member detects the presence and the absence of the rolled recording material on said supporting member by using a member for detecting whether or not said supporting member is rotating.

8. A recording apparatus according to claim 1, wherein said feed detecting member detects the presence and the absence of the rolled recording material on said supporting member by a lever which rotates around a predetermined fulcrum, and of which one end applies force to the rolled recording material if the rolled recording material is present on said supporting member and applies force to said supporting member if the rolled recording material is not present on said supporting member, and by a lever detecting member which detects the other end of said lever.

9. A recording apparatus according to claim 1, wherein said feed detecting member is provided with a lever which rotates around a predetermined fulcrum, and of which one end applies force to the rolled recording material if the rolled recording material is present on said supporting member and applies force to said supporting member if the rolled recording material is not present on said supporting member, and with a detecting member, at said one end of said lever, which discriminatingly detects a color of the rolled recording material and a color of said supporting member, and thus detects the presence and the absence of the rolled recording material on said supporting member.

* * * * *

UNITED STATES PATENT AND TRADEMARK OFFICE

CERTIFICATE OF CORRECTION

PATENT NO. : 6,592,217 B2
DATED : July 15, 2003
INVENTOR(S) : Hideyuki Tanaami

It is certified that error appears in the above-identified patent and that said Letters Patent is hereby corrected as shown below:

Title page,
Item [56], References Cited, FOREIGN PATENT DOCUMENTS,
"356070254" should read -- 56-70254 --.
"402144362" should read -- 2-144362 --.
"404354749" should read -- 4-354749 --.
"2001/076081" should read -- 2001-076081 --.

Figure 14:
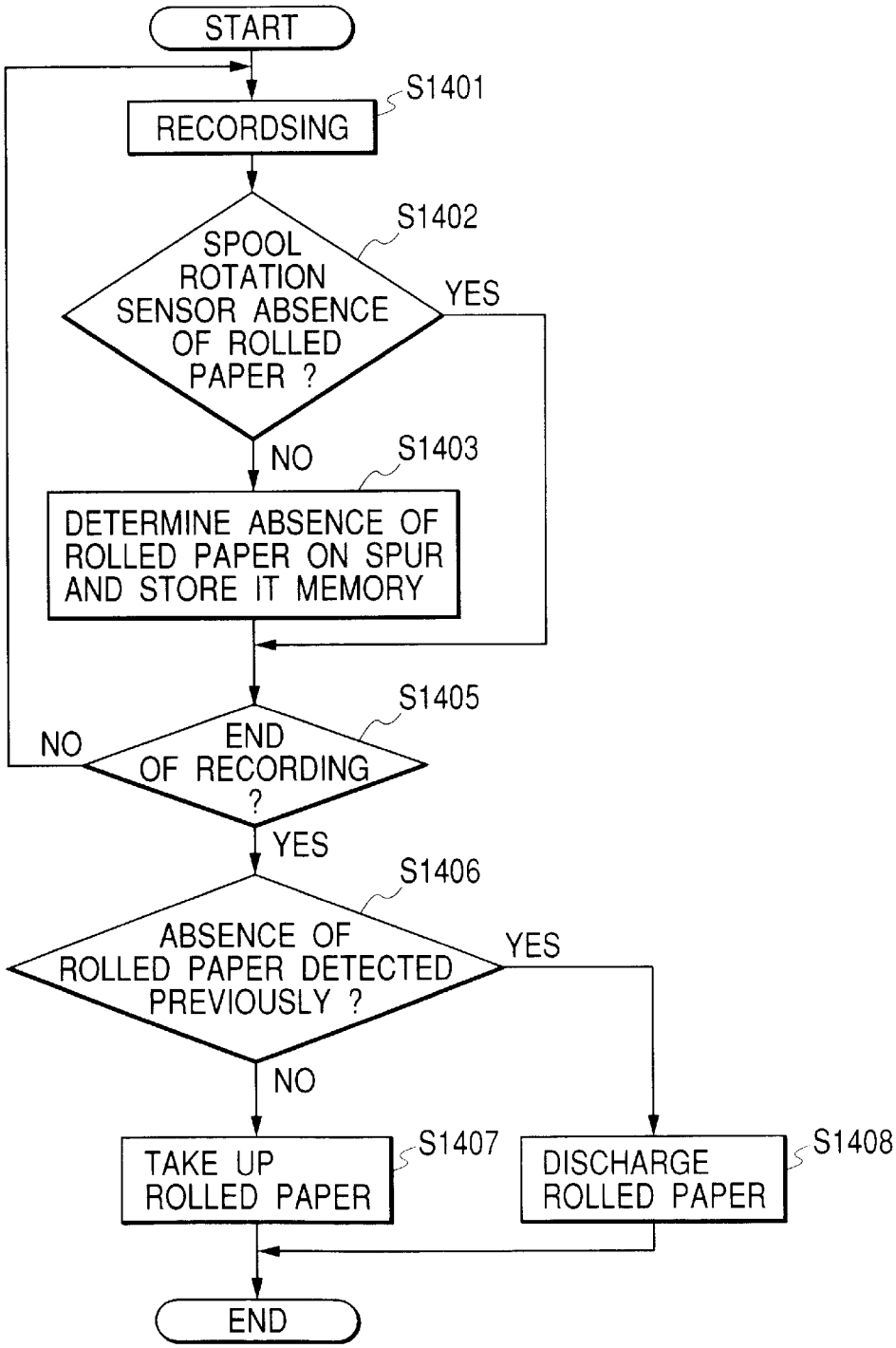
FIG. 14 is a flow chart for explaining another example of the rolled paper conveying control operation by the recording apparatus shown in FIG. 10.

Drawings,
Sheet 14, Figure 14, "RECORDSING" should read -- RECORDING --.

Signed and Sealed this

Thirtieth Day of December, 2003

JAMES E. ROGAN
*Director of the United States Patent and Trademark Office*